US009231360B2

(12) United States Patent
Smith

(10) Patent No.: US 9,231,360 B2
(45) Date of Patent: Jan. 5, 2016

(54) CRIMPER TOOL

(71) Applicant: Dennis K. Smith, Anderson, CA (US)

(72) Inventor: Dennis K. Smith, Anderson, CA (US)

( * ) Notice: Subject to any disclaimer, the term of this patent is extended or adjusted under 35 U.S.C. 154(b) by 0 days.

(21) Appl. No.: 14/465,400

(22) Filed: Aug. 21, 2014

(65) Prior Publication Data

US 2015/0052966 A1 Feb. 26, 2015

Related U.S. Application Data

(60) Provisional application No. 61/959,433, filed on Aug. 23, 2013.

(51) Int. Cl.

| | |
|---|---|
| ***B21D 7/06*** | (2006.01) |
| ***H01R 43/042*** | (2006.01) |
| ***B25B 29/02*** | (2006.01) |
| ***B25B 25/00*** | (2006.01) |

(52) U.S. Cl.
CPC ..... *H01R 43/042* (2013.01); *B25B 25/00* (2013.01); *B25B 29/02* (2013.01)

(58) Field of Classification Search
CPC ..... H01R 43/042; B25B 25/00; B25B 29/02
USPC ..... 72/454
See application file for complete search history.

(56) References Cited

U.S. PATENT DOCUMENTS

| | | | | |
|---|---|---|---|---|
| 2,202,125 | A * | 5/1940 | Temple, Jr. | 72/415 |
| 2,744,429 | A * | 5/1956 | Seely | 72/370.23 |
| 2,809,546 | A * | 10/1957 | Broske | 72/414 |
| 3,078,904 | A * | 2/1963 | Bishop et al. | 72/412 |
| 3,260,098 | A * | 7/1966 | Gill | 72/416 |
| 3,266,287 | A * | 8/1966 | Gill | 72/416 |
| 3,316,744 | A | 5/1967 | Spangler | |
| 4,117,711 | A | 10/1978 | Medcraft | |
| 4,192,171 | A | 3/1980 | Hamilton | |
| 4,459,839 | A * | 7/1984 | Cochran et al. | 72/412 |
| 4,655,064 | A | 4/1987 | Hoback | |
| 4,833,875 | A | 5/1989 | Buermann, Jr. et al. | |
| 5,711,078 | A | 1/1998 | Patton et al. | |
| 7,305,749 | B2 | 12/2007 | Kramer | |

OTHER PUBLICATIONS

NOCO D800 Blue Hammer Indent Crimping Tool by NOCO, http://www.amazon.com, Jan. 10, 2012,.

EZ Red B790C Hammer Indent Crimping Tool, Toolsource Item No. 110665, http://www.toolsource.com.

Stride Tool Imperial BS104 Battery Terminal Lug Crimper, http://www.skygeek.com.

Greenlee (a Textron company) L Series Battery-Powered 4-Ton Crimping Tool, Item No. GL-EK41012, http://www.cableorganizer.com.

Cooper Lug Crimping Tool, Item No. 99065, http://www.delcity.net.

Heavy Duty Crimping Tool, EZ Red Company, Item No. B795, http://www.ezred.com/Product-Pages/B795.htm.

EZ Red B794 Crimping Tool, Bench Mount 25 in., Item No. EZB794, http://www.autotoolworld.com.

* cited by examiner

*Primary Examiner* — David B Jones
(74) *Attorney, Agent, or Firm* — Breiner & Breiner, L.L.C.

(57) ABSTRACT

A portable crimper tool is disclosed having a frame, a crimper anvil and a bolt adapted to engage the frame and connected to the crimper anvil for actuation of the crimper tool.

13 Claims, 10 Drawing Sheets

CRIMPER TOOL

RELATED APPLICATION

This application claims benefit of U.S. Provisional Application Ser. No. 61/959,433, filed Aug. 23, 2013, entitled "Crimper Tool," and incorporated herein by reference in its entirety.

FIELD OF THE INVENTION

The present invention relates to a crimper tool. More particularly the invention relates to a crimper tool that is handheld and portable and having a unique crimper anvil.

BACKGROUND OF THE INVENTION

Crimper tools are known in the art including as sold by E-Z Red Company under Product No. B790c. However, many of these tools have shortcomings including (1) the tools are not versatile in use; (2) the tools cannot reach tight spots; (3) they only provide one crimp in the terminal and wire, thereby sometimes not making a solid connection; and (4) similar problems.

Accordingly, the known tools while useful for certain applications have various shortcomings. These and other shortcomings of such tools are addressed by the present invention.

SUMMARY OF THE INVENTION

A primary object of the present invention is to provide a crimper tool that is handheld and portable.

Another primary object of the present invention is to provide a crimper tool that allows the user to take the crimper into tight places that are difficult or impossible to reach using standard long handled crimpers.

Another primary object of the invention is to provide a crimper tool designed to accommodate a ⅜ inch ratchet and/or a ⅜ inch extension to clamp a three point jaw down onto a wire and terminal to make three detents into the terminal end wire, thereby making a solid connection.

It is a further object of the invention to provide a crimper tool also designed to be held by a ¾ inch/19 millimeter open-end wrench.

It is another primary object of the invention to provide a crimper tool actuated by a bolt engaging a crimper anvil, the crimper anvil having a socket and ball bearing adapted to engage the bolt to provide for ease of actuation.

It is another object of the invention to provide a crimper tool which can be held in a vise for a work bench.

The crimper tool of the present invention comprises a frame having a base, an anvil block, a support member, and a bolt receptacle; a crimper anvil; and a bolt adapted to engage the bolt receptacle of the frame and connected to the crimper anvil for actuation of the crimper tool.

These primary and other objects of the invention will be apparent from the following description of the preferred embodiments of the invention and from the accompanying drawings.

BRIEF DESCRIPTION OF THE DRAWINGS

The following detailed description of the specific non-limiting embodiments of the present invention can be best understood when read in conjunction with the following drawings.

Referring to the drawings.

DETAILED DESCRIPTION OF THE PREFERRED EMBODIMENTS

Figure 1:
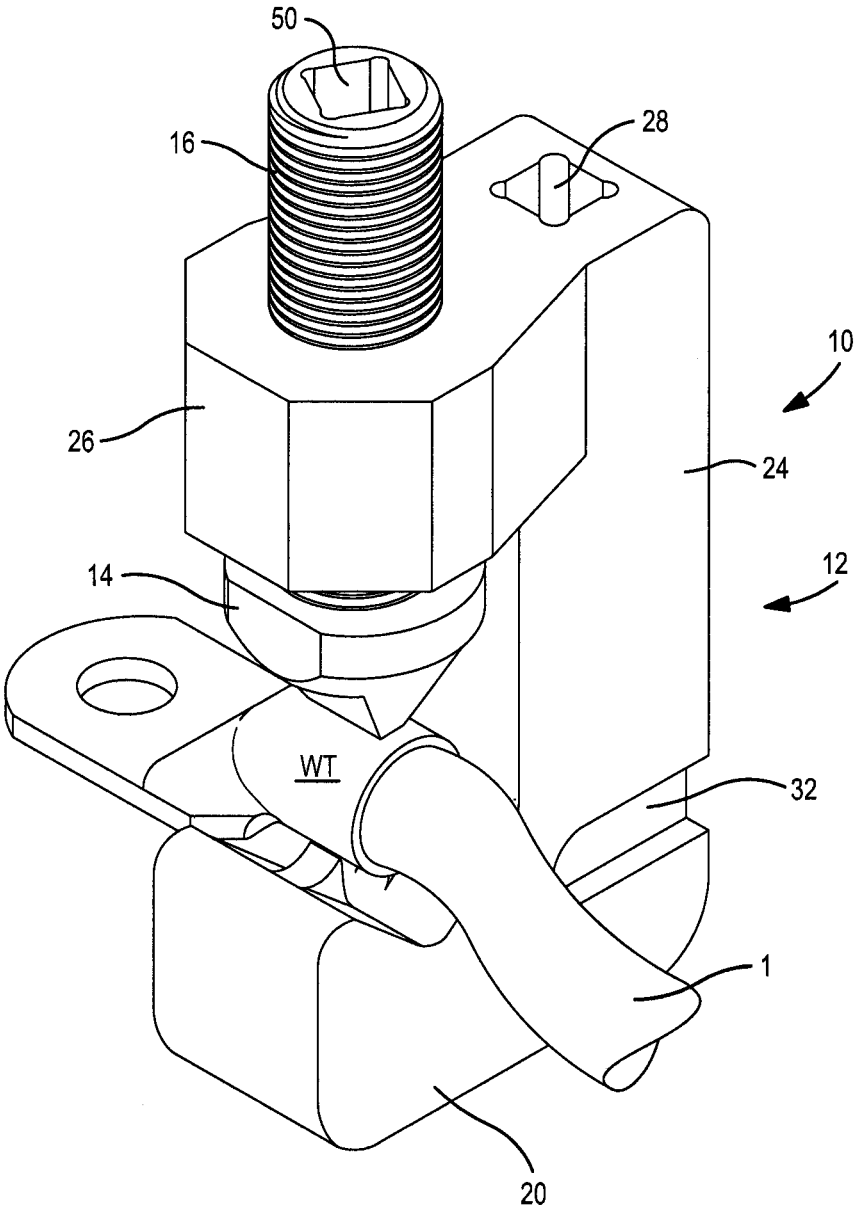
FIG. 1 discloses a perspective view of the crimper tool of the invention.
Figure 2:
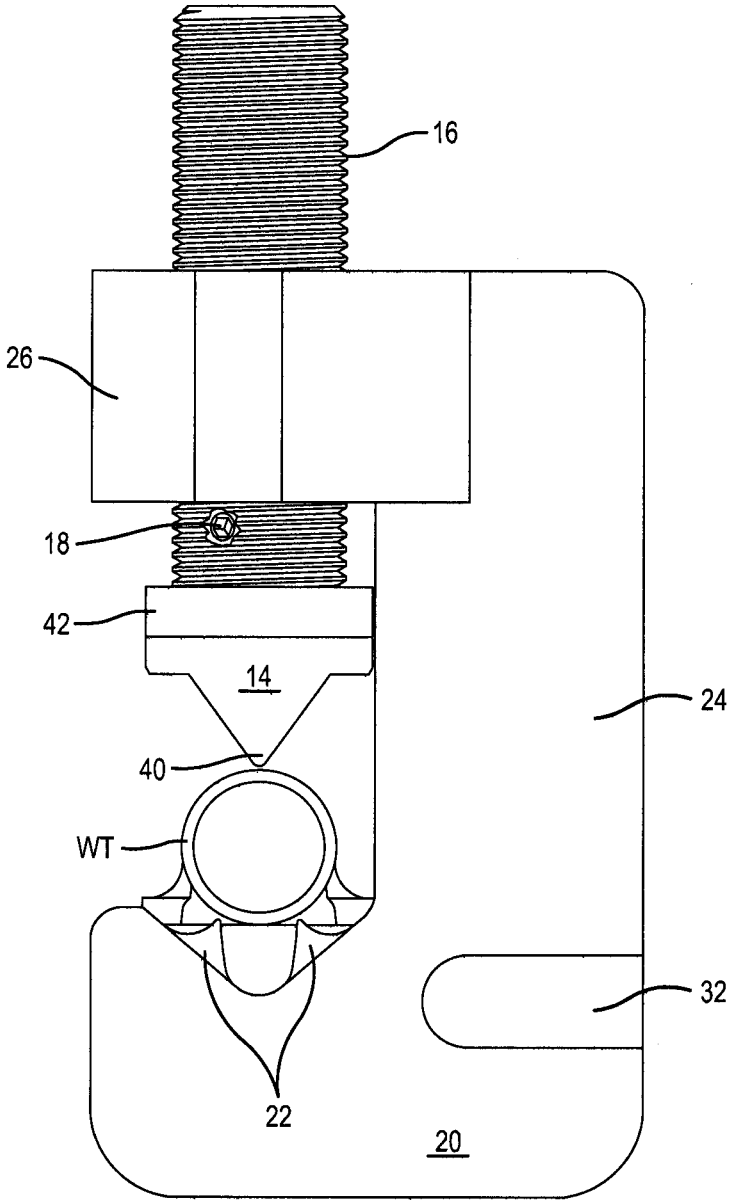
FIG. 2 discloses a side elevational view of the invention of FIG. 1.
Figure 3:
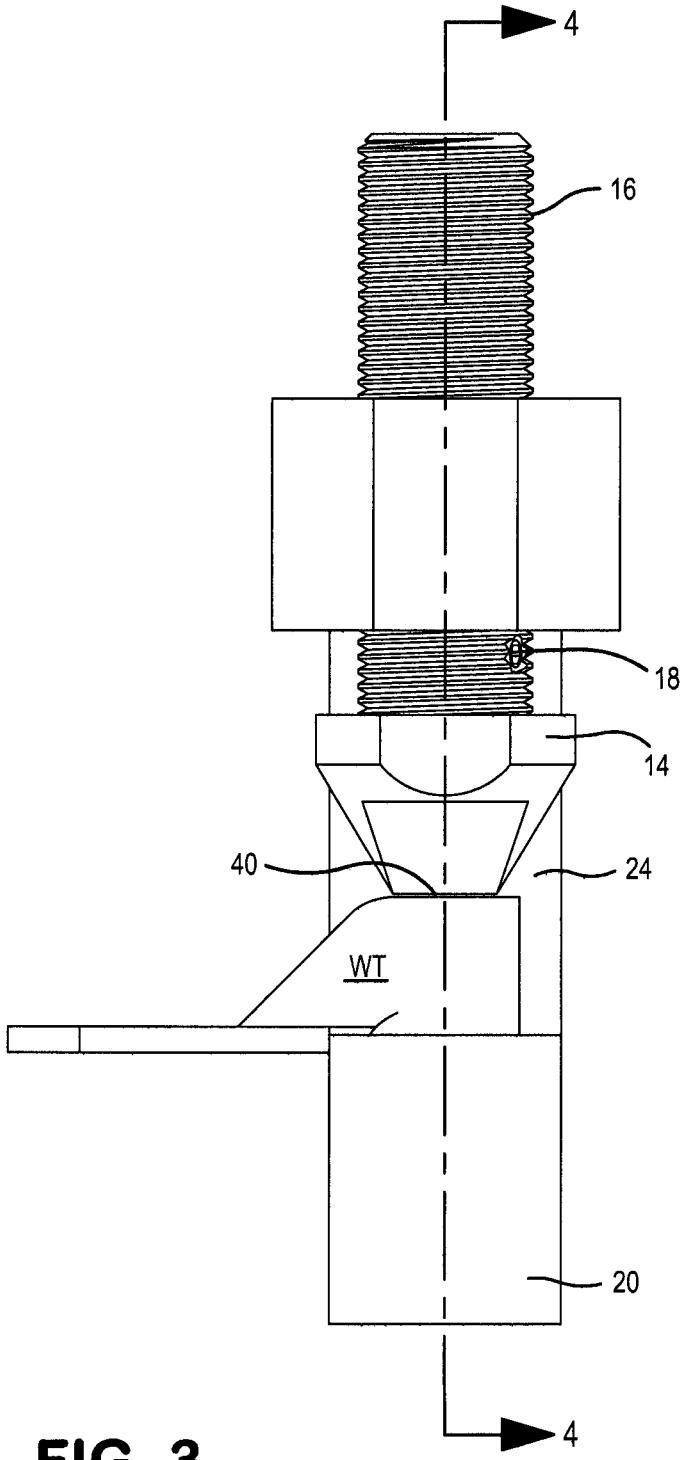
FIG. 3 discloses a front elevational view of the crimper tool of FIG. 1.

The present invention is directed to a crimper tool for providing a three detent crimp into a terminal and wire making a solid connection. The crimper tool is handheld and portable or may be held by an open-end wrench or a vise.

Referring to the Figures, the crimper tool 10 includes a frame 12, a crimper anvil 14 and an actuating bolt 16. The frame and crimper anvil are preferably made of tempered steel, although other suitable materials may be used without departing from the scope of the invention.

The frame 12 includes a base 20, a two point anvil block 22, a support member 24 and a bolt receptacle 26. The frame includes openings 28 and 30 for being held by a tool such as, but not limited to, a ⅜ inch drive extension or ratchet as well as a 19 millimeter or ¾inch open end wrench. The frame further includes recesses 32 for being held by a vise.

The crimper anvil 14 is attached to bolt 16 by an alien screw 18 at tapping hole 19. The crimper anvil includes tip 40 and flat sides 42. The flat sides 42 preclude the turning of the crimper anvil. The crimper anvil includes a first socket 44 for engaging a ball bearing 46 in relation to the bolt 16.

Figure 4:
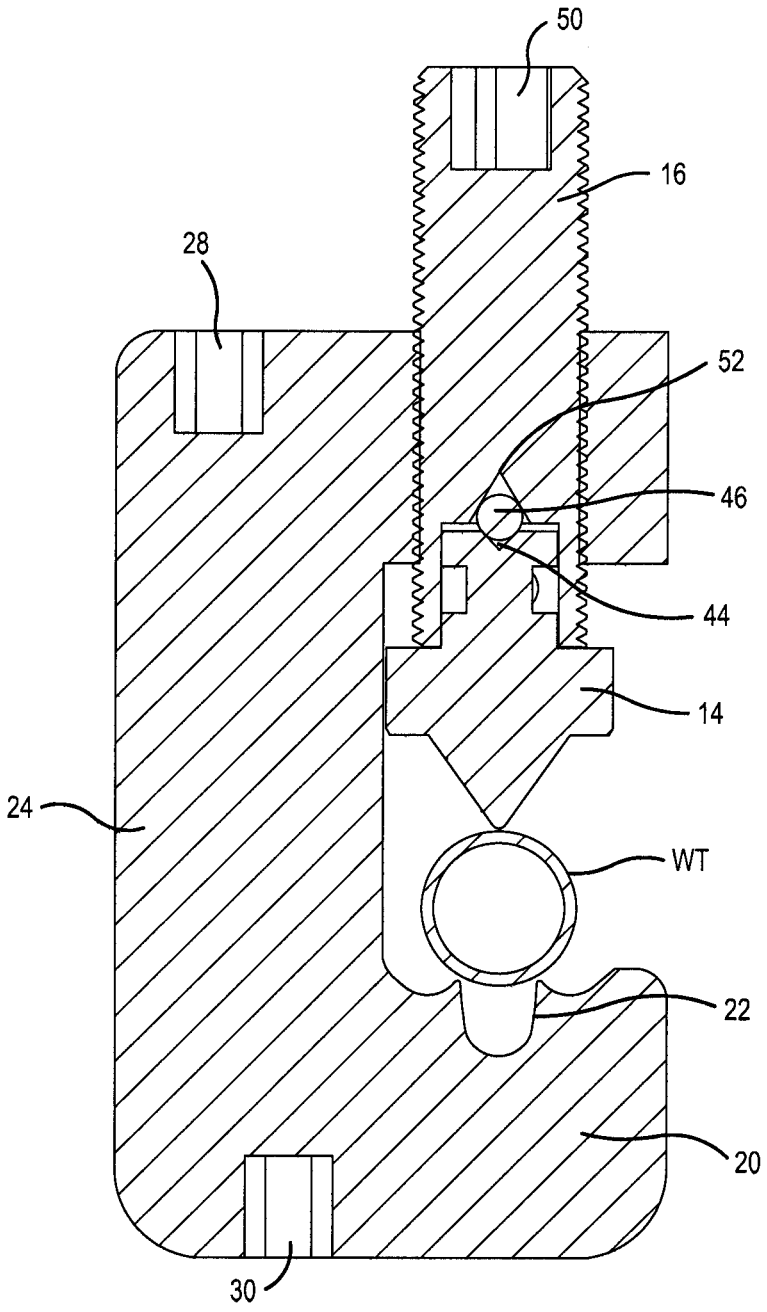
FIG. 4 shows a cross-sectional view taken along line 4-4 of FIG. 3.
Figure 5:
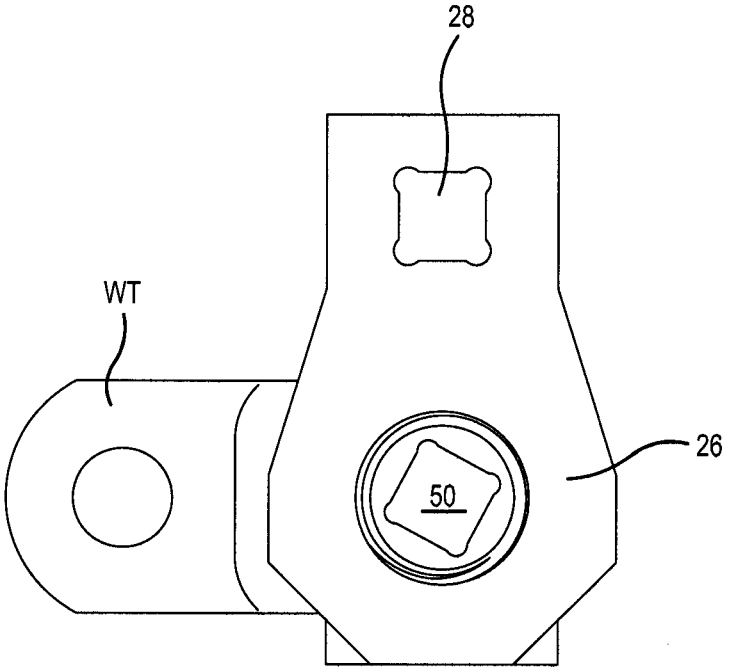
FIG. 5 discloses a top view of the invention of FIG. 1.
Figure 6:
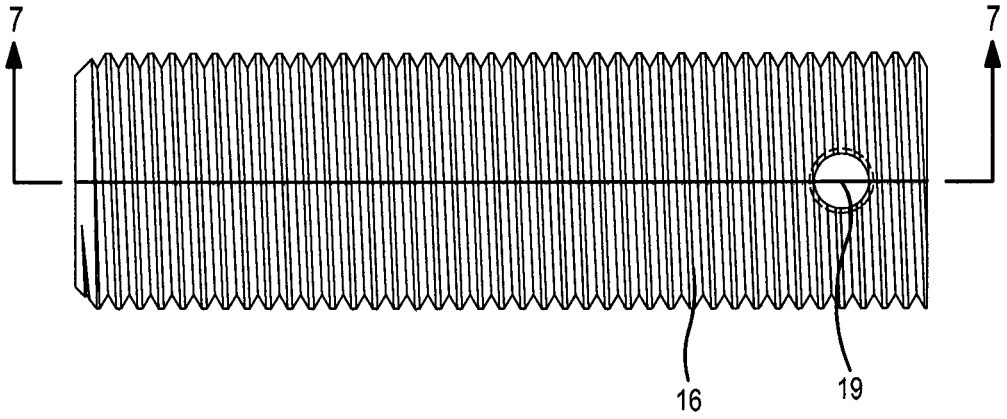
FIG. 6 discloses the bolt of the crimper tool of FIG. 1.
Figure 7:
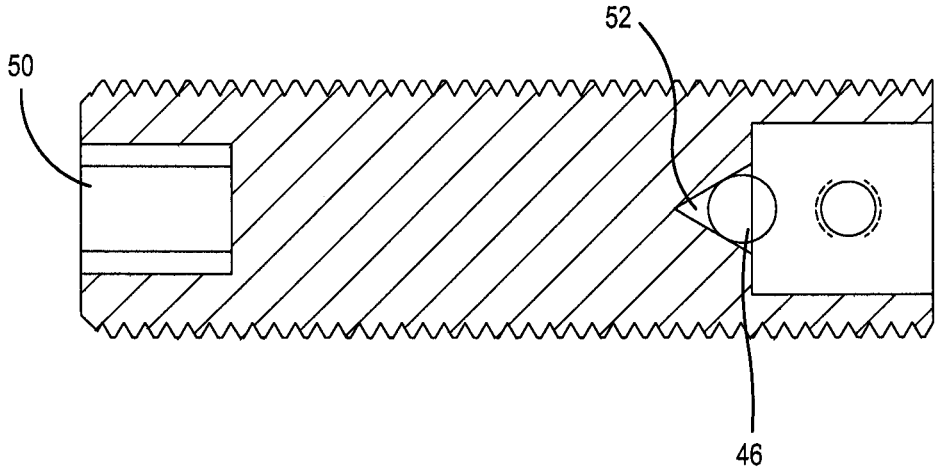
FIG. 7 discloses a cross-sectional view of the bolt taken along line 7-7 of FIG. 6.
Figure 8:
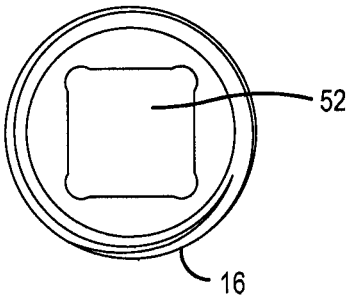
FIG. 8 discloses a top view of the bolt of FIG. 6.
Figure 9:
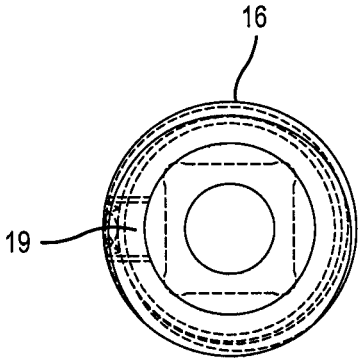
FIG. 9 discloses bottom view of the bolt of FIG. 6.
Figure 10:
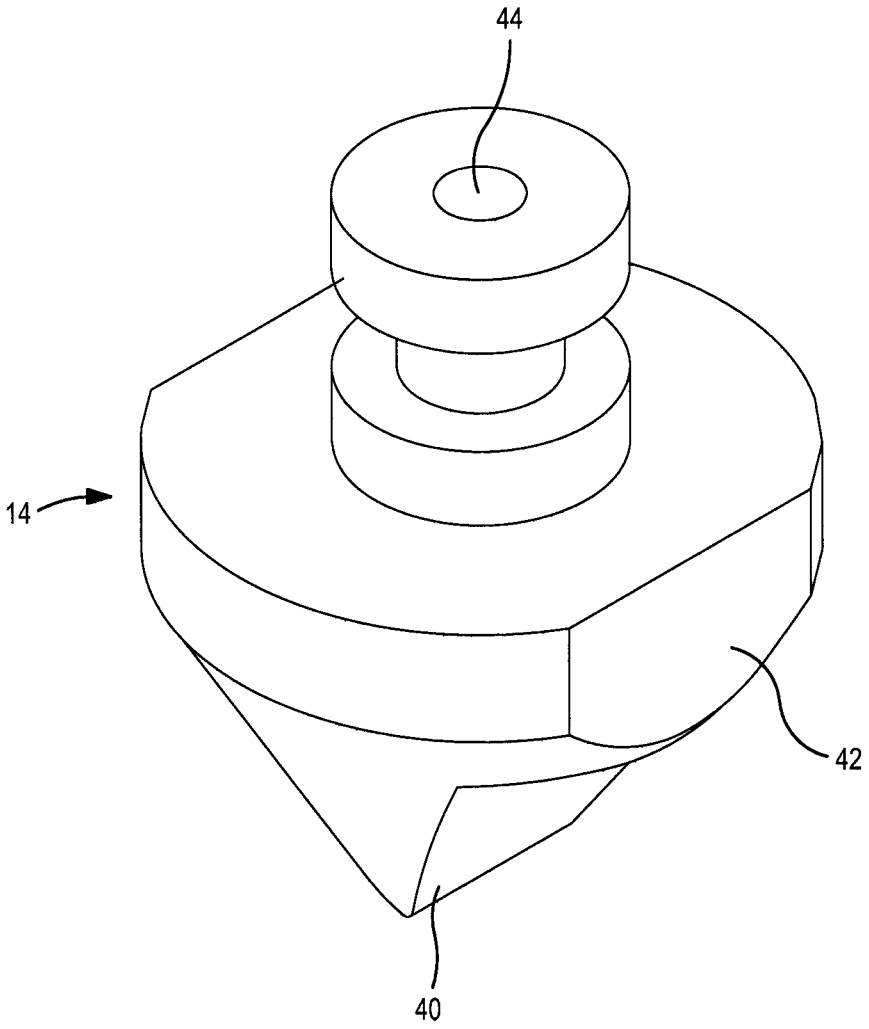
FIG. 10 discloses a perspective view of the crimper anvil of the invention.
Figure 11:
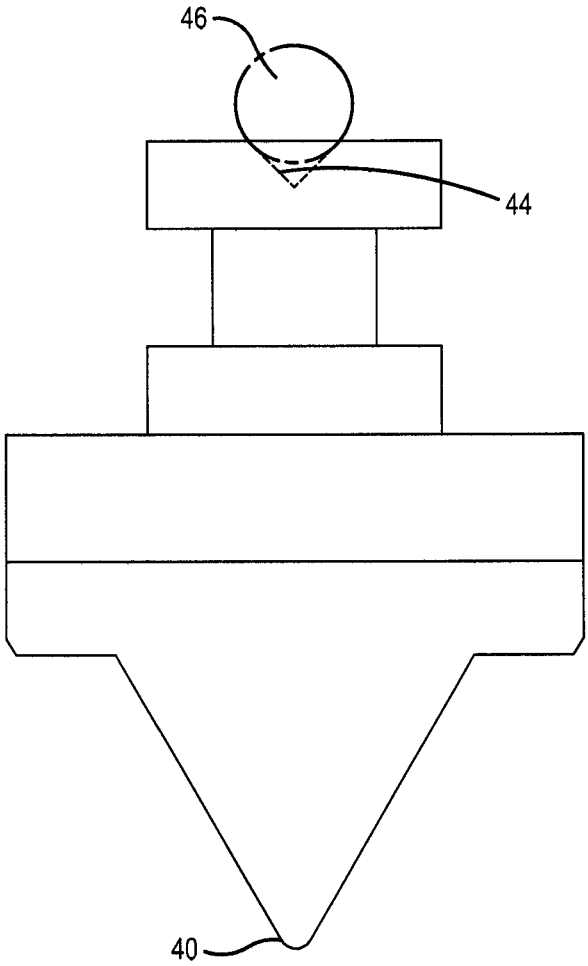
FIG. 11 discloses a front elevational view of the crimper anvil of the invention.
Figure 12:
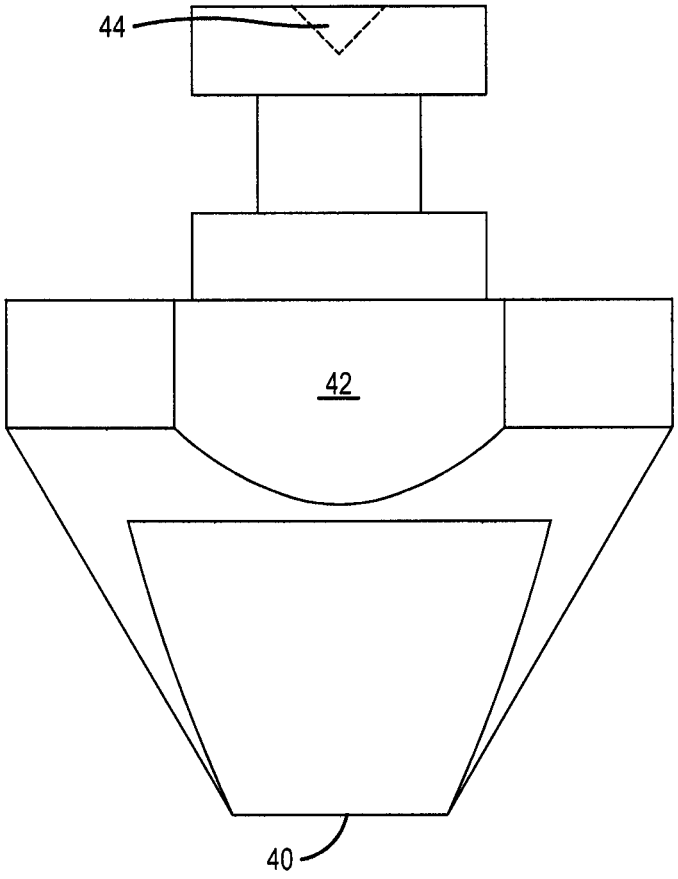
FIG. 12 discloses a side elevational view of the crimper anvil of the invention.

The crimper tool actuating bolt 16 includes a ratchet receptacle 50 for a tool such as, but not limited to, a ⅜ inch ratchet or ⅜ inch impact drill to move the crimper anvil into contact with the wire terminal WT; that is by downward movement of actuating bolt 16 by corresponding threads on actuating bolt 16 and actuating bolt receptacle 26 as shown in FIG. 4. The actuating bolt further includes a second socket 52 for receiving a ball bearing 46, thereby allowing the smooth vertical actuation of the bolt.

As shown in the Figures, a wire terminal WT having a wire 1 (partially shown in FIG. 1) is placed in the tool having the ability to make two detents into the wire terminal at anvil block 22. The actuating bolt 16 is engaged by a wrench in the ratchet receptacle 50 and the crimper anvil is moved downward to crimp the wire terminal. When the crimper anvil tip 40 engages a wire terminal, a three detent crimp will be made making a solid connection in the wire.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A portable crimper tool comprising: (a) a frame having a base, an anvil block, a support member, and a bolt receptacle; (b) a crimper anvil connected to said frame by a bolt; (c) said bolt engages said bolt receptacle of said frame and connected to said crimper anvil for actuation of the crimper tool; and (d) wherein said crimper anvil includes a first socket and wherein said bolt includes a ratchet receptacle at one end and a second socket at the opposite end, and said crimper tool further includes a ball bearing in a recess created by said first socket and said second socket.

2. A portable crimper tool according to claim 1 wherein said anvil block comprises a two point anvil block.

3. A portable crimper tool according to claim 2 wherein said crimper anvil of said crimper tool includes a tip member, said crimper tool being adapted to provide a three point crimp.

4. A portable crimper tool According to claim 1 wherein said crimper anvil comprises a crimper head and is constructed and arranged to preclude turning of said crimper head.

5. A portable crimper tool according to claim 4 wherein said crimper anvil includes flat sides.

6. A portable crimper tool according to claim 1 wherein said support of said frame and said base of said frame include an opening constructed and arranged to allow for engagement of said crimper tool with a tool.

7. A portable crimper tool according to claim 1 wherein said base of said frame includes a recess at each side of said base constructed and arranged for said crimper tool to be held by a vise.

8. A portable crimper tool comprising: (a) a frame having a base, a two point anvil block, a support member, and a bolt receptacle; (b) a crimper anvil connected to said frame by a bolt and having a crimper head and a first socket; (c) said bolt having a ratchet receptacle at one end and a second socket at the opposite end and engages said bolt receptacle of said frame and connected to said crimper anvil for actuation of the crimper tool; and (d) wherein said first socket and said second socket form a recess and further comprising a ball bearing in said recess.

9. A portable crimper tool according to claim 8 wherein said crimper anvil of said crimper tool includes a tip member, said crimper tool being adapted to provide a three point crimp.

10. A portable crimper tool according to claim 9 wherein said crimper anvil comprises a crimper head and is constructed and arranged to preclude turning of said crimper head.

11. A portable crimper tool according to claim 10 wherein said crimper anvil includes flat sides.

12. A portable crimper tool according to claim 11 wherein said support of said frame and said base of said frame each include an opening constructed and arranged to allow for engagement of said crimper tool with a tool.

13. A portable crimper tool according to claim 12 wherein said base of said frame includes a recess at each side of said base constructed and arranged for said crimper tool to be held by a vise.

* * * * *